US011123892B2

(12) United States Patent
Richter et al.

(10) Patent No.: US 11,123,892 B2
(45) Date of Patent: Sep. 21, 2021

(54) FRAME FOR A CUTTING MACHINE

(71) Applicant: Bizerba SE & Co. KG, Balingen (DE)

(72) Inventors: Hannes Richter, Balingen (DE); Nikolaus Koch, Geislingen (DE); Timo Capone, Balingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/856,045

(22) Filed: Apr. 23, 2020

(65) Prior Publication Data

US 2020/0246994 A1 Aug. 6, 2020

Related U.S. Application Data

(63) Continuation of application No. 15/769,345, filed as application No. PCT/EP2016/080066 on Dec. 7, 2016, now Pat. No. 10,675,775.

(30) Foreign Application Priority Data

Dec. 9, 2015 (DE) ..... 10 2015 121 457.1

(51) Int. Cl.

| | |
|---|---|
| ***B26D 7/06*** | (2006.01) |
| ***B26D 1/15*** | (2006.01) |
| ***B26D 1/153*** | (2006.01) |
| ***B26D 7/32*** | (2006.01) |
| ***B26D 7/08*** | (2006.01) |

(52) U.S. Cl.

CPC ..... *B26D 7/0616* (2013.01); *B26D 1/15* (2013.01); *B26D 1/153* (2013.01); *B26D 7/32* (2013.01);

(Continued)

(58) Field of Classification Search

CPC ..... B26D 2210/02; B26D 7/22; B26D 7/225; B26D 7/32; B26D 7/325; B26D 1/143;

(Continued)

(56) References Cited

U.S. PATENT DOCUMENTS 3,583,452 A 6/1971 Muller et al.
3,702,150 A * 11/1972 Muller ..... B26D 7/01 83/707

(Continued)

FOREIGN PATENT DOCUMENTS

DE 3644716 A1 7/1988
DE 10017157 B4 2/2006

(Continued)

OTHER PUBLICATIONS

Engineering Exchange, 11 Principles and Guidelines in Design for Manufacturing and Assembly, https://www.engineeringexchange.com/profiles/blogs/11-principles-and-guidelines-in-design-for-manufacturing-and (Year: 2014).

*Primary Examiner* — Evan H MacFarlane
(74) *Attorney, Agent, or Firm* — Leydig, Voit & Mayer Ltd.

(57) ABSTRACT

A method produces a frame for a transport device for receiving slices of material separated by a cutting blade of a cutting machine. The method includes: providing a single integral workpiece, the single integral workpiece having a base plate region, a first longitudinal side region on a first side of the base plate region, and a second longitudinal side region on a second side of the base plate region, bending the first longitudinal side region along a first longitudinal side bending edge until the first longitudinal side region is perpendicular to the base plate region, and bending the second longitudinal side region along a second longitudinal side bending edge until the second longitudinal side region is perpendicular to the base plate region. The first longitudinal side region and second longitudinal side region each extend away from the base plate region in a first direction, and are parallel to each other.

18 Claims, 6 Drawing Sheets

(52) U.S. Cl.
CPC .... *B26D 2007/082* (2013.01); *B26D 2210/02* (2013.01)

(58) Field of Classification Search
CPC ..... B26D 7/0616; B26D 1/15; B26D 1/153; B26D 2007/082; Y10S 83/932; Y10T 83/6508
USPC ..... 83/713, 932
See application file for complete search history.

(56) References Cited

U.S. PATENT DOCUMENTS

| | | | | | |
|---|---|---|---|---|---|
| 3,713,470 | A | | 1/1973 | Muller et al. | |
| 3,965,783 | A | * | 6/1976 | Muller | B26D 7/32 83/88 |
| 4,793,228 | A | | 12/1988 | Herbert et al. | |
| 5,101,702 | A | | 4/1992 | Kuchler | |
| 5,224,407 | A | * | 7/1993 | Koch | B26D 7/01 83/42 |
| 5,934,449 | A | | 8/1999 | Dolan | |
| 6,170,645 | B1 | | 1/2001 | Mitchell | |
| 2006/0054473 | A1 | | 3/2006 | Spoors | |
| 2016/0325456 | A1 | | 11/2016 | Wangler et al. | |

FOREIGN PATENT DOCUMENTS

| | | | |
|---|---|---|---|
| DE | 60315864 | T2 | 5/2008 |
| DE | 102009011883 | A1 | 9/2010 |
| EP | 0456634 | A2 | 11/1991 |

* cited by examiner

FRAME FOR A CUTTING MACHINE

CROSS-REFERENCE TO PRIOR APPLICATIONS

This application is a continuation of U.S. patent application Ser. No. 15/769,345, filed on Apr. 19, 2018, which is a U.S. National Phase application under 35 U.S.C. § 371 of International Application No. PCT/EP2016/080066, filed on Dec. 7, 2016, and claims benefit to German Patent Application No. DE 10 2015 121 457.1, filed on Dec. 9, 2015. The entire contents of each of which are hereby incorporated by reference herein.

FIELD

The invention relates to a frame for a cutting machine.

BACKGROUND

DE 100 17 157 B4 discloses a chain track frame. The chain track frame is mounted on a cutting machine and aligned transversely to a cutting blade of the cutting machine. The chain track frame receives the slices of material that are separated by the cutting blade in order to transport them transversely with respect to the cutting plane. The chain track frame has a sturdy frame to which individual components are attached. So, for example, a pressure roller is pivotably mounted on the frame to receive individual slices of material. Also attached to the frame are guide rollers, over which transport chains are guided circumferentially. The frame itself is made up of a plurality of individual parts which are riveted or bolted together.

SUMMARY

In an embodiment, the present invention provides a method that produces a frame for a transport device for receiving slices of material separated by a cutting blade of a cutting machine. The method includes: providing a single integral workpiece, the single integral workpiece having a base plate region, a first longitudinal side region on a first side of the base plate region, and a second longitudinal side region on a second side of the base plate region, bending the first longitudinal side region along a first longitudinal side bending edge until the first longitudinal side region is perpendicular to the base plate region, and bending the second longitudinal side region along a second longitudinal side bending edge until the second longitudinal side region is perpendicular to the base plate region. The first longitudinal side region and second longitudinal side region each extend away from the base plate region in a first direction, and are parallel to each other.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
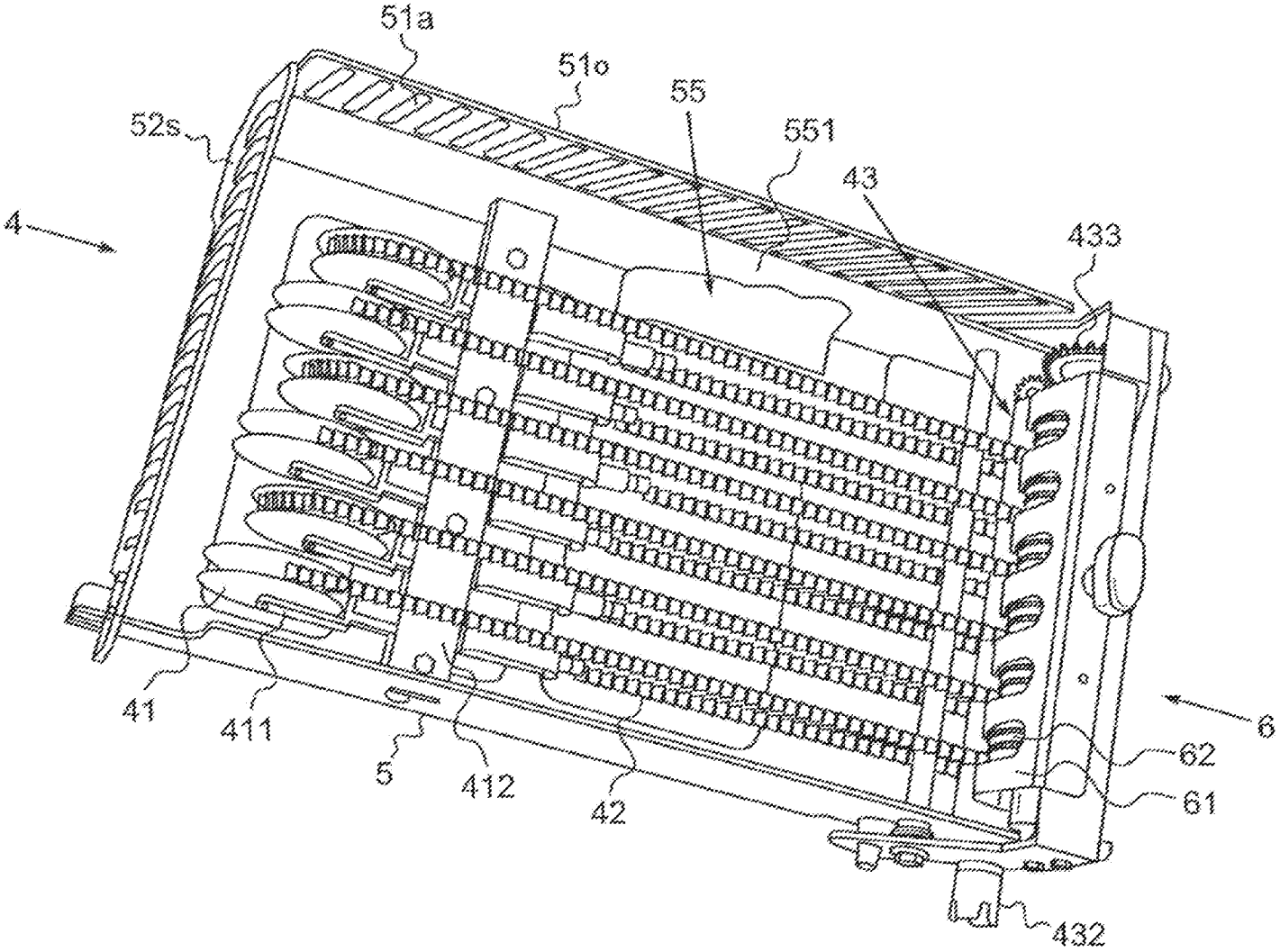
FIG. 1 is a view of a transport device according to the invention from the front.

According to the invention, the transport device has a frame which is designed as a single part. The frame forms a mechanically stable rack to support individual components of the transport device or the chain track frame. "Single part" here means that the frame is formed of a single integral workpiece. As a result, additional manufacturing steps are avoided in the manufacture of the transport device, such as the joining or the connection of a plurality of individual parts to a mechanically stable frame. Designing the frame as a single part in the sense of a single integral workpiece also provides a mechanically stable structure because joints, which can represent weaknesses per se, are avoided from the outset. Also, manufacturing errors are avoided, which can be caused, for example, by a joining process or a welding process or a screwing or riveting process. Preferably, "designed as a single part" in this sense means formed as a single part or monolithically. The frame is preferably formed as a workpiece made of a single material. A plurality of individual parts that are joined to a frame is not necessary. Foreign material inclusions such as those produced by welding or soldering are not present. The frame is constructed from a single material and can therefore be easily recycled or disposed of after it has reached the end of its lifespan.

Preferably, the transport device is designed as a chain track frame to receive from a cutting machine, preferably a food slicer, individual slices that are separated from the material to be cut directly in the cutting region of a cutting blade and to transport them to a deposit region. A receiving apparatus is mounted on the frame for this purpose and receives the slices from the cutting blade and passes them to a plurality of parallel transport chains or transport belts of the frame. The plurality of transport chains arranged in parallel with one another on the frame are guided at one end over guide rollers and at the other end through a drive device which drives the transport chains or transport belts for transporting the slices. The drive device can be connected to a drive of a cutting machine via a coupling.

Transport chains are in particular closed-loop chains. They have a plurality of interconnected chain links, spikes for skewering slices of material being arranged on individual chain links.

Transport belts are in particular closed-loop belts, which have spaced-apart spikes for the purpose of skewering slices of material.

In particular, elongated food products, such as sausage or cheese or meat products, can be used as the material to be cut, of which individual slices are separated and transported by the transport device.

Advantageously, the frame can be designed as a single part from a flat plate, preferably from a metal plate or a plastics plate.

In particular, the frame may have a plurality of functional units formed together as a single integral piece. For example, the frame, in addition to a rack for holding the guide rollers, can also comprise a hand guard and/or intervention guard and/or a scraper. The frame may have, as a single part, a rack for supporting the guide rollers that is integrally formed with a hand guard and/or intervention guard and/or a scraper.

In the production of the transport device, the procedure is preferably such that, to produce the frame, a part corresponding to a two-dimensional flat pattern of the frame is first of all cut out or punched out of a flat plate. A rectangular frame is then formed by folding over two opposing longitudinal sides. The flat pattern of the frame can be cut out, for example, by laser cutting or water jet cutting. As a plate, preferably a metal plate or a plastics plate may be used. In particular, an aluminum plate or a stainless-steel plate is used as the starting material for the production of the frame, on the one hand to achieve the necessary mechanical stability and on the other hand to ensure a hygienic surface.

In one embodiment, the frame can have an integrated handle. A further cost reduction in production can be obtained by also cutting out or punching out a cutout and/or contour forming the handle when cutting out or punching out the two-dimensional flat pattern of the frame.

The handle is preferably formed in one cycle during the folding process. The handle can be formed by folding a hand guard and by folding a longitudinal side. This ensures that the frame already comprises a handle that has been integrated into the frame as a single part, without additional operational steps being necessary, such as screwing on a separate handle part or welding on a separate handle piece.

In one embodiment, it is intended in particular for the frame to have a substantially rectangular design by virtue of the frame having a flat base plate and two opposing longitudinal sides being bent so that they are parallel to each other and at right angles to the base plate. Longitudinal sides are those sides of the frame which, in the position of use on a cutting machine, extend transversely with respect to the cutting plane. The end face refers to the side which, in the position of use of the transport device, extends in parallel with a cutting plane and is on the side of the frame facing away from the cutting blade.

In the production of the transport device or the chain track frame, it is in particular provided, after the completion of the folding operational step, for other components to be attached to the frame. For example, the receiving apparatus for receiving slices and the plurality of guide rollers that are arranged at a distance from one another and the drive device for driving a plurality of transport chains or transport belts that extend in parallel with each other are fastened to the frame, preferably screwed and/or riveted. This means that the frame is formed from a single workpiece first by cutting and folding. Thereafter, further components of the transport device are attached to the frame to complete the chain track frame or the transport device.

In one embodiment, in order to ensure an ergonomically favorable operation and reliable operator protection, the handle may have a handle contour extending along a longitudinal side of the frame with a rounded or wavy shape and a hand guard extending out from the base plate that is angled toward a transport chain or transport belt. The wave-shaped handle contour allows an operator to have a secure grip on the frame when he grasps it and not slip off accidentally. The hand guard prevents an operator from accidentally reaching into the transport chain or transport belt.

In addition, the operator safety can be increased by the frame, in one embodiment, having on one longitudinal side an extension in the form of a first intervention-guard plate, which is angled relative to one longitudinal side in such a way that it is inclined toward the opposite longitudinal side. In addition, the frame may have, on the end face thereof, a second intervention-guard plate that extends at an angle relative to the base plate, preferably at a right angle. During operation of the transport device, the intervention-guard plates prevent an operator from accidentally reaching into the transport region of the transport chains or the transport belts. As a result, the risk of injury when operating the transport device is significantly reduced.

In order to give an operator a good view into the transport device, one of the intervention-guard plates or both intervention-guard plates can have cutouts in the form of slots. In particular, the intervention-guard plates have a plurality of parallel narrow slots that are narrow enough that an operator cannot reach through a slot with a finger. Another advantage is that these cutouts or slots reduce the weight of the frame. This contributes to savings of material and also allows easier manipulation of the transport device.

Advantageously, the transport device has an upper intervention guard arranged on the frame and/or a lateral intervention guard. For easy handling, the frame may also have a handle. In particular, the frame is designed as a single part with the upper intervention guard and/or the lateral intervention guard and/or the handle. In particular, made of a single material. In addition to simple production of the transport device, this also allows for increased dishwasher resistance of the transport device, since the frame dispenses with a material mix made up of different materials.

The transport device according to the invention is preferably used on a cutting machine for cutting off slices from an, in particular, elongated material to be cut. Cutting machines of this kind are used as slicing machines for food. For example, cutting machines of this kind are used in the sale of fresh sausage or cheese products in order to cut and put together portions sold at the request of the customer.

Cutting machines of this kind are known in practice as vertical cutting units, i.e. designed having a vertically extending cutting plane, and have a machine housing on which a drive motor and a cutting blade rotationally driven thereby in a cutting plane are mounted. Furthermore, a linearly displaceable carriage for supporting material to be cut is arranged in the region in front of the cutting blade.

In particular, the machine housing can removably support the transport device in a region behind the cutting blade. Since the transport device is removably mounted on the machine housing, the transport device can be easily removed for cleaning purposes and be cleaned as a whole unit in a dishwasher. After cleaning, the transport device can be attached to the cutting machine or the machine housing again. Simple interchangeability of the transport device for maintenance or repair purposes can thus also be achieved.

In one embodiment, the transport device can be a part of a modular system, the modular system in addition to the transport device comprising a plurality of different types of cutting machines. Each of the cutting machines of the modular system is designed to detachably support the transport device.

In order to deposit the separated slices, the machine housing in particular has a dislodging device comprising a depositing grille that is pivotable about a pivot axis extending in parallel with a longitudinal side of the frame and engages between the transport chains or transport belts and during its pivoting detaches slices from the transport device and takes them to a deposit region. In order to increase the operator safety, the width of the first intervention-guard plate can be dimensioned so as to be equal to or greater than the largest pivot path of the removal grille. This prevents an operator from accidentally intervening in the space between removal grille and transport chains or transport belts when the depositing grille is pivoted out. Otherwise, there would be a risk that when the removal grille is pivoted back, the hand of the operator could be caught between the removal grille and the transport chains or transport belts.

In particular, the width of the second intervention-guard plate on the end face is also equal to or greater than the maximum pivot path of the depositing grille, or the second intervention-guard plate covers a circle segment which extends over an angular range that is equal to or greater than the maximum pivot angle of the depositing grille.

In FIGS. 1 to 5, embodiments of the invention are shown, the same components each being provided with the same reference signs.

Figure 2:
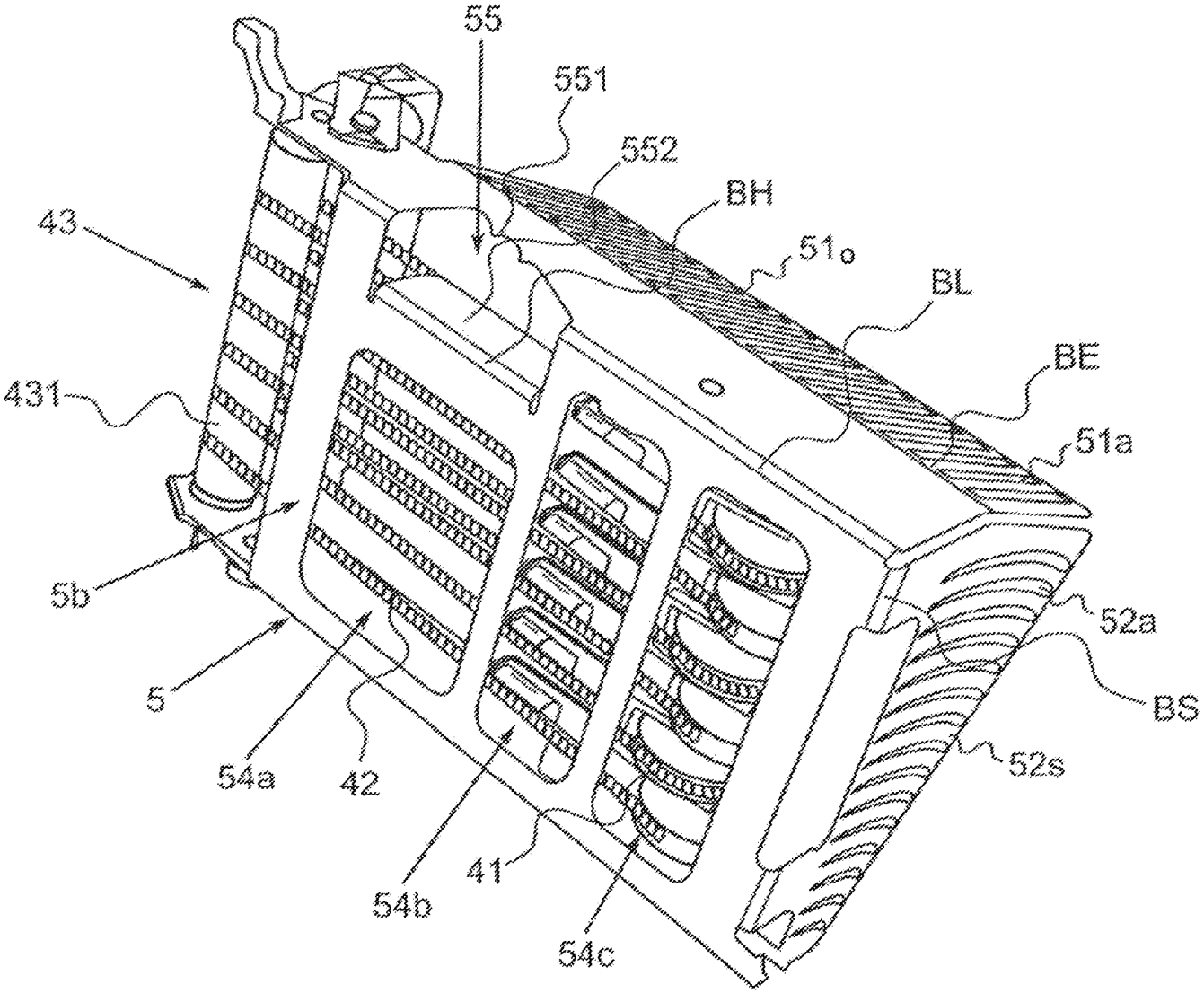
FIG. 2 is a view of the transport device from behind.

FIGS. 1 and 2 show an embodiment of the transport device 4 according to the invention that is designed as a chain track frame for a cutting machine 1. The transport device 4 has a frame 5 which is designed as a single part and serves as a stable mechanical support for individual components of the transport device 4. The transport device 4 comprises a receiving apparatus (also referred to as a receiver) 6 having pressure rollers 62 and an allocator 61. The receiving apparatus 6 is pivotably mounted on the frame 5. Separated slices are received from a cutting blade 2 of a cutting machine 1 (FIG. 5) and transported by the receiving apparatus 6 by means of the pressure rollers 62.

Mounted on the frame 5 is a plurality of transport chains 42 that are parallel to each other. The transport chains 42 comprise individual interconnected chain links, which in turn have spikes for skewering the separated slices of material. The transport chains 42 are guided in an endlessly circulating manner by guide rollers 41 mounted on the frame 5. The separated slices are received by the pressure rollers 62 and transported to the transport chains 42. The slices are removed from the pressure rollers 62 and slipped onto the transport chains 42 by means of the allocator 61.

The frame 5 holds, as a further component, a drive device 43. The drive device (also referred to as a driver) 43 has a drive roller 431 to drive the transport chains 42 and to transport the slices of material transversely with respect to a cutting plane. The transport chains 42 are continuously circulating via the drive roller 431 at one end and guide rollers 41 at the other end.

The guide rollers 41 are attached to the chain track frame 5 in parallel with and at a distance from each another via a retaining web 412. Each guide roller 41 has a rocker 411 which supports the guide roller 41 and connects to the web 412.

As can be seen from FIGS. 1 and 2, the frame 5 is designed to be substantially cuboid. As a rear side, it has a flat base part 5*b*, which is folded forward at the two opposing longitudinal sides and forms a substantially cuboid body. To save weight, cutouts 54*a*, 54*b*, 54*c* are incorporated in the flat base part 5*b* of the frame 5.

At the top side, the frame 5 has an upper intervention guard 510 designed as a single part with the frame 5. The intervention guard is formed as an angled extension of the upper longitudinal side of the frame 5 and has a plurality of slots 51*a* extending in parallel with each other.

On its end face, the frame 5 also has a lateral intervention guard 52*s* formed integrally therewith as a single part. Also arranged in the lateral intervention guard 52*s* is a plurality of cutouts 52*a* extending in parallel with each other.

In the region of the upper longitudinal side, the frame 5 has an integrated handle 55. This handle 55 comprises a handle contour 551 formed in the frame 5 and a hand guard 552. From the back of the frame 5, an operator can grasp the handle in order to lift the transport device 4 or to transport the transport device 4 or to connect it to a cutting machine 1.

When the transport device 4 is connected to the cutting machine, a frictional connection is produced between a drive of the cutting machine 1 and the drive device 43 via a coupling 432. The coupling 432 is arranged on the underside of the frame 5 and is rotatably connected to the drive roller 431 via a shaft. The shaft extends through a cutout in the lower longitudinal side of the frame 5 and connects the coupling 432 to the drive shaft 43 in a rotationally fixed manner.

Figure 5:
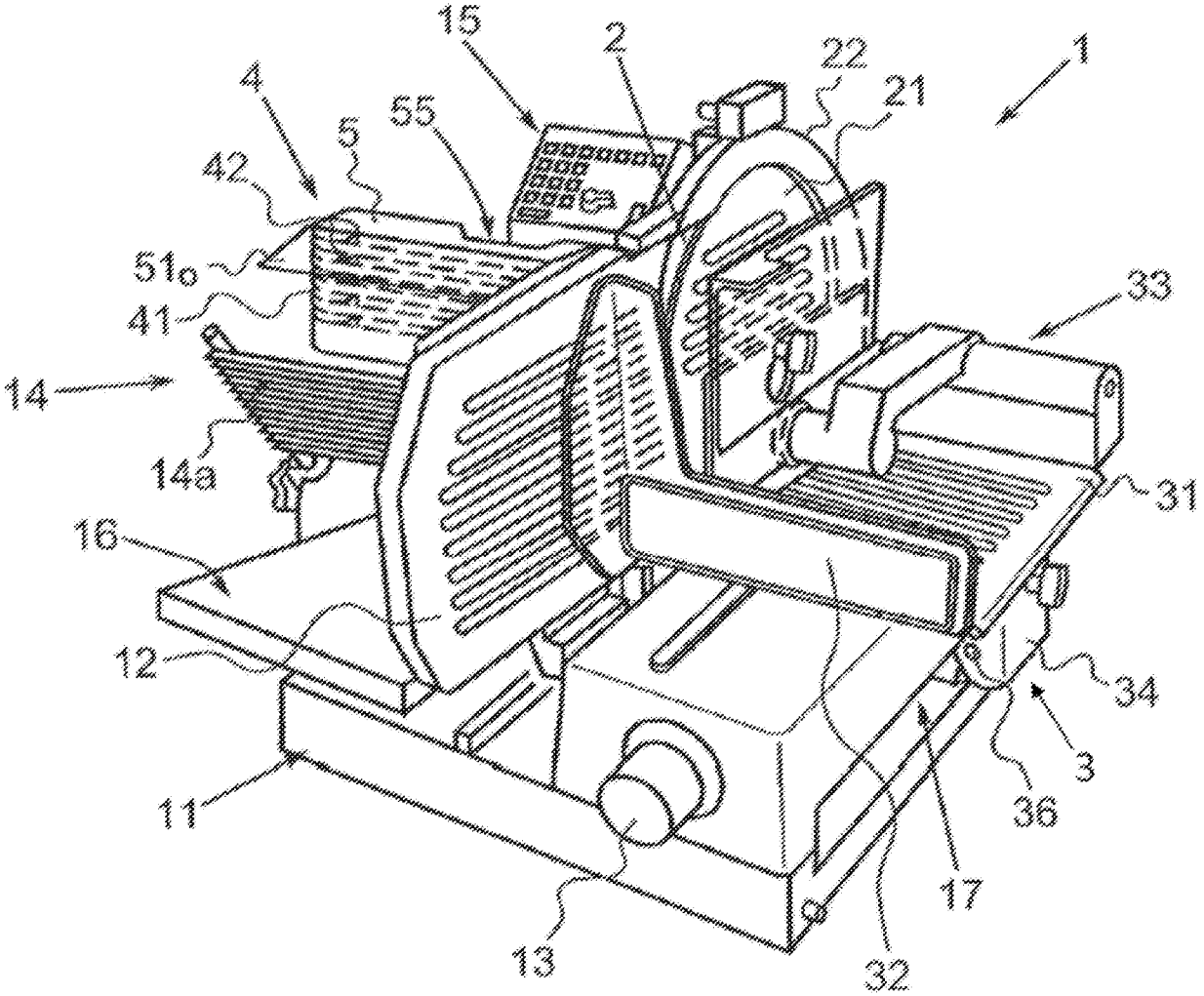
FIG. 5 is an illustration of a cutting machine comprising a transport device according to the invention.

FIG. 5 shows a cutting machine 1 comprising the transport device 4 according to the invention. The cutting machine 1 has a machine housing 11, on which a motor turret 15 projects upwards. In the motor turret 15, a drive motor (not depicted) is received that connects to and drives a circular cutting blade 2. An operating and/or display unit for operating the cutting machine 1 is arranged at the top of the motor turret 15.

The cutting blade 2 is covered in the region of the cutting edge thereof by a C-shaped circular blade guard 22 in order to prevent inadvertent contact with the cutting edge of the cutting blade 2. The front of the cutting blade 2 is covered in a planar manner with a blade cover 21 in order to prevent contact with the flat side of the rotary cutting blade 2 during the cutting operation.

In the region in front of the cutting blade 2, a stop plate 12 that is displaceable in parallel with the cutting blade 2 is mounted on the machine housing 11. By means of an adjustment knob 13, the stop plate 12 can be adjusted in order to set a desired cutting thickness. The stop plate 12 is adjustable perpendicular to a cutting plane of the blade 2.

Furthermore, the machine housing 11 supports a carriage 3 which is displaceable in the direction parallel to the cutting plane. The carriage 3 has a carriage foot 34, via which the carriage 3 is mounted in a linearly displaceable manner on the machine housing 11 via a linear guide 17. The carriage 3 comprises a support plate 31 for supporting material to be cut and a hand guard 32 and a material holder 33. Both the material holder 33 and the hand guard 32 are made partially transparent in order to give an operator a view into the carriage 3 or into the cutting region.

The material to be cut is placed on the surface of the support plate 31 and held by the material holder 33. During the cutting process, the material to be cut is conveyed to the cutting blade 2 by means of the material holder 33. By means of the back and forth movement of the carriage 3, individual slices are separated from the elongated material by means of the cutting blade 2. These separated slices are taken up behind the cutting blade 2 by the transport device 4 and are conveyed transversely with respect to the cutting plane. The slices are detached from the transport device 4 and deposited in a deposit region 16 by means of a dislodging device 14 comprising a pivotable removal grille 14*a*. The pivotable removal grill (or depositing grille) 14*a* is pivotable about a pivot axis extending in parallel with a longitudinal side of the frame 5 and engages between the transport chains 42 and during its pivoting detaches slices from the transport device 4 and takes them to the deposit region 16. In order to increase the operator safety, the width of the upper intervention-guard plate 51 can be dimensioned so as to be equal to or greater than the maximum pivot path of the removal grille 14*a*. This prevents an operator from accidentally intervening in the space between removal grille 14*a* and transport chains 42 when the removal grille 14*a* is pivoted out. Otherwise, there would be a risk that when the removal grille 14*a* is pivoted back, the hand of the operator could be caught between the removal grille 14*a* and the transport chains 42 belts.

The transport device 4 is detachably mounted on the machine housing 11 and in a simple manner can be removed or connected to the machine housing 11 via the handle 55.

Figure 3:
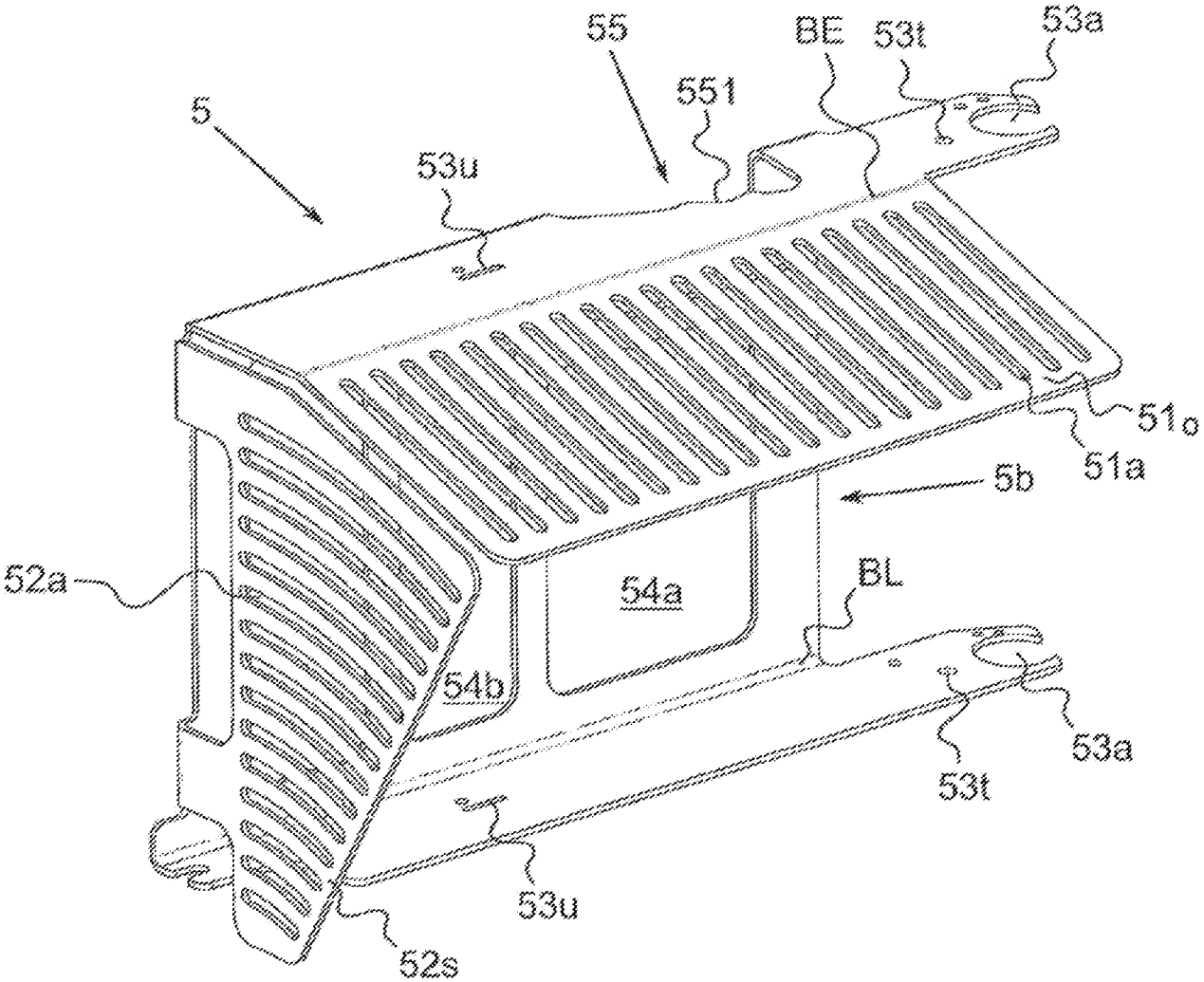
FIG. 3 is an illustration of the frame without attachments.

In FIG. 3, the frame 5 formed from a single flat plate is shown as such, that is, without further components of the transport device 4. FIG. 4 shows the two-dimensional flat pattern 5*f* of the frame 5.

Figure 4A:
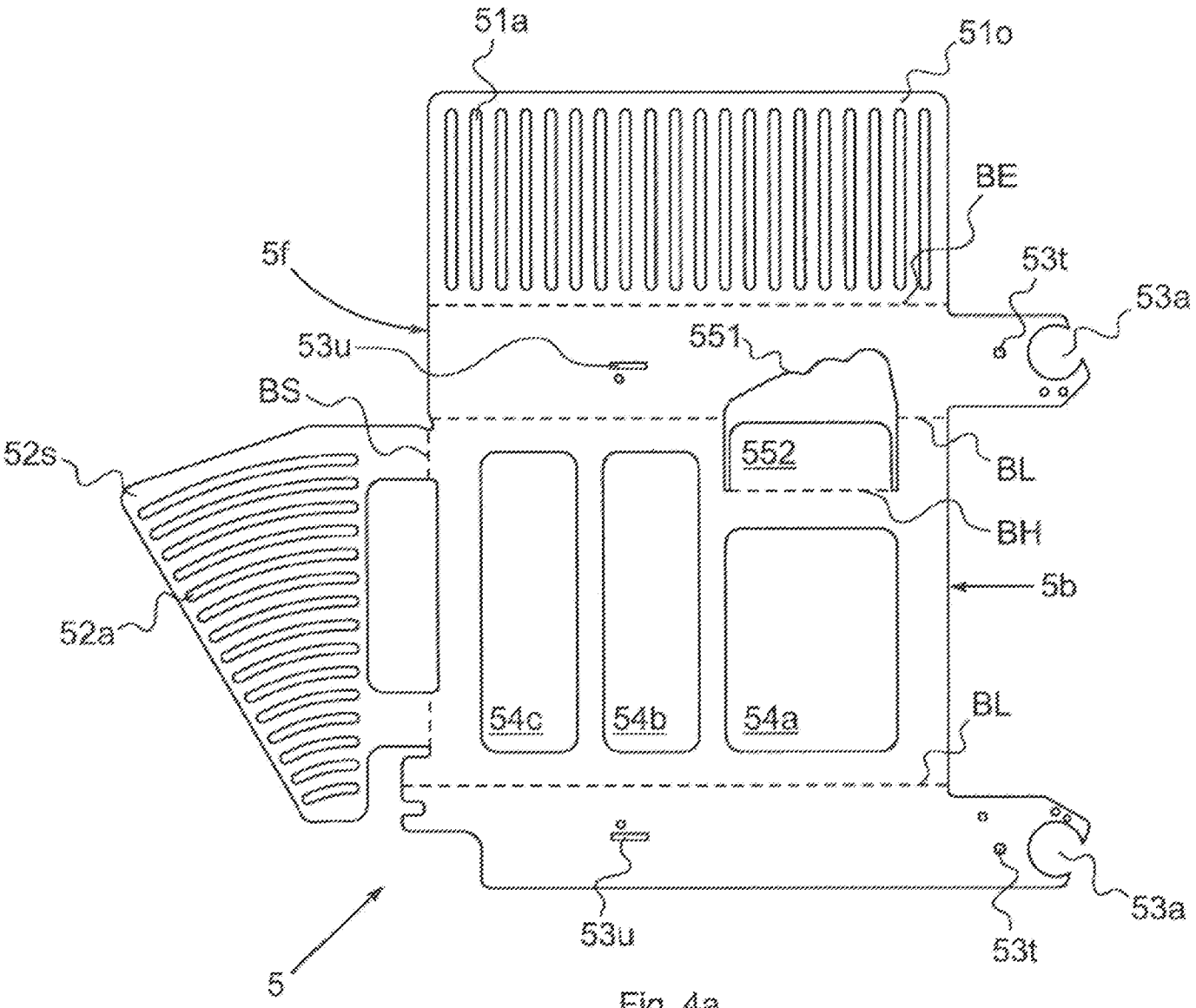
FIG. 4*a* is an illustration of the cut-out flat pattern of the frame.

In the production of the frame 5 of the transport device 4, the two-dimensional flat pattern 5*f* shown in FIG. 4*a* is first of all cut out or punched out of a flat plate. The flat pattern 5*f* already has all the necessary individual parts of the frame 5. The flat pattern 5*f* has a central base plate 5*b* comprising the cutouts 54*a*, 54*b*, 54*c* and a handle having a handle contour 551 and a hand guard 552. Furthermore, in the region of the upper longitudinal side, the upper intervention guard 510, together with the cutouts 51*a* thereof, is integrally joined to the base plate 5*b*. The lateral intervention guard 52*s*, together with the cutouts 52*a* thereof, is arranged at the end-face end of the base plate 5*b*. Furthermore, the flat part 5*f* of the frame 5 already has the cutouts for fastening further components, for example the cutouts 53*u* for fastening the guide rollers or the cutouts 53*t* for fastening the receiving apparatus or the cutouts 53*a* for fastening the drive device.

The flat pattern 5*f* of the frame 5 is produced in a first step starting from a flat plate either by punching it out or by cutting it out, for example by laser cutting or water jet cutting. Subsequently, the flat part 5*f* is formed into a cuboid frame 5 by folding along prefabricated bending lines and is shown in FIG. 3. The folding is done along predetermined bending edges. Two bending edges BL arranged on the longitudinal side are provided in order to form the two opposing longitudinal sides of the frame 5. On the upper longitudinal side, a further bending edge BE is arranged in order to form the upper intervention guard 51*a*. On the end face of the base plate 5*b*, the lateral intervention guard 52*s* is formed by folding along the bending edge BS. The configuration of the handle 55 results from folding along the bending edge BH of the hand guard 552. The folding is done as cold forming of the flat workpiece 5*f* along the bending edges, it being possible for the bending edges to be notched in advance to facilitate the bending process.

After folding and producing the substantially cuboid three-dimensional frame 5, the transport device 4 is completed by attaching the other components of the transport device to the frame 5.

The frame 5 is designed as a single part, which already comprises an upper intervention guard 510 and a lateral intervention guard 52*s* and also a handle 5. Thus, a material mix is avoided, as is customary in the prior art, for example, in that transparent plastics plates or plastics handles are typically used as intervention guards. As a result, in addition to better recycling, the dishwasher resistance is also improved in the transport device according to the invention.

Figure 4B:
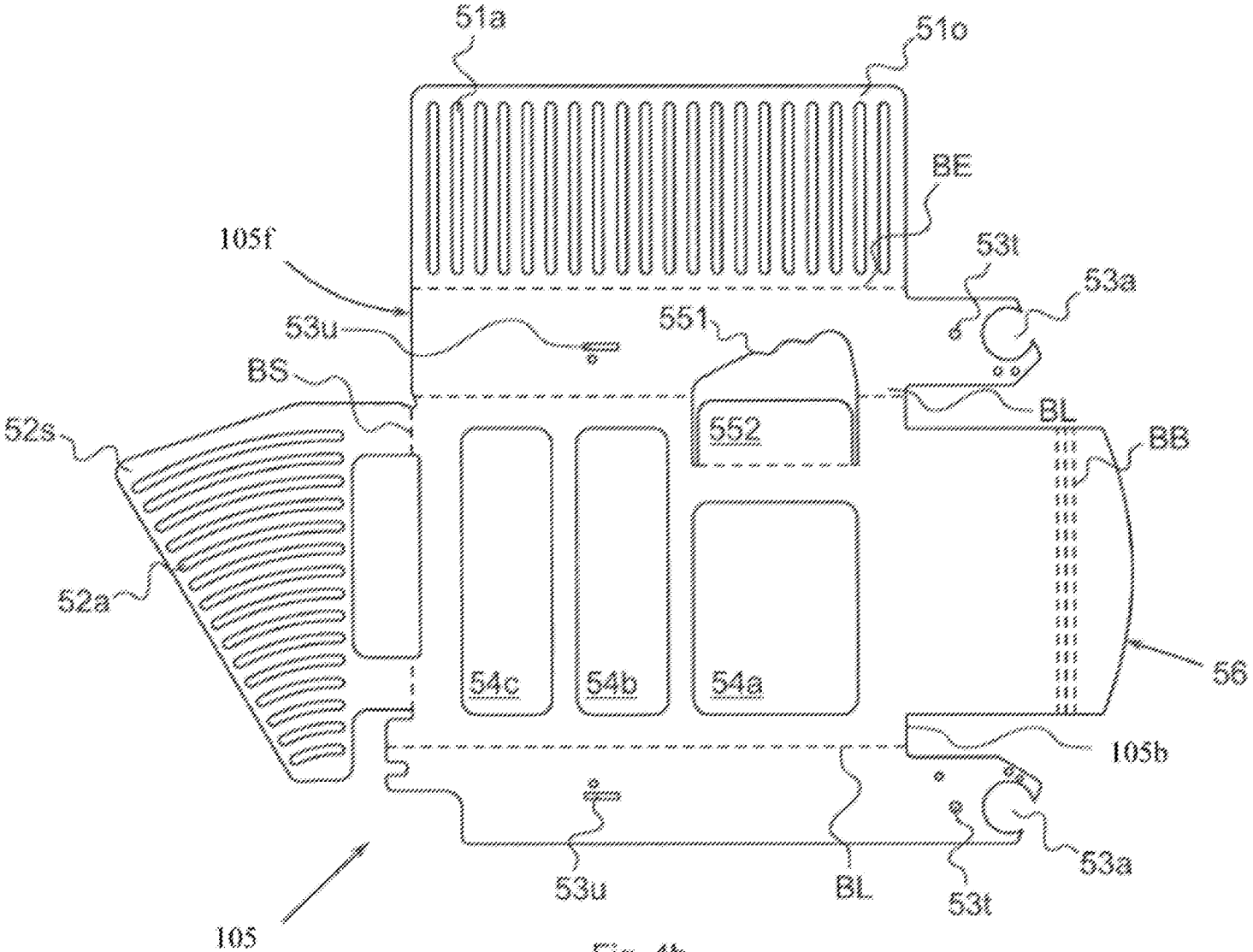
FIG. 4*b* is an illustration of a variant of the flat pattern of the frame.

FIG. 4*b* shows a variant of the frame 105 as a flat pattern. The frame 105 corresponds to the embodiment shown in FIG. 4*a* and also has a scraper 56 as an additional functional component. The frame 105 is designed in this example as a single part, which already comprises an upper intervention guard 510 and a lateral intervention guard 52*s* and a scraper and also a handle 55.

On its side opposite the end face, the frame 105 has a scraper 56 that is integrally joined to the base plate 105*b*. The scraper 56 is connected to the base plate 105*b* via a bending region BB. After the flat pattern is cut out, the scraper is bent forward, the bending region obtaining a curvature having a predetermined bending radius.

When the frame 105 is mounted on the cutting machine 1, the scraper 56 is located in the region behind the cutting blade 2. Said scraper is only at a short distance from the cutting blade 2 or touches it. The slices are detached from the cutting blade 2 by the scraper 56 during the cutting process and passed to the receiving apparatus 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 cutting machine
11 machine housing
12 stop plate
13 cutting thickness adjustment
14 dislodging device
14*a* depositing grille
15 motor turret
16 deposit region
17 linear guide
2 cutting blade
21 blade cover
22 circular blade guard
3 carriage
31 support plate
32 hand guard
33 material holder
34 carriage foot
4 transport device/chain track frame
41 guide roller
411 rocker
412 retaining web
42 transport chain
43 drive device
431 drive roller
432 coupling

433 gear
5 frame
5*f* flat frame
5*b* base plate
51*o* upper intervention guard
51*a* upper cutouts
52*s* lateral intervention guard
52*a* lateral cutouts
53*a* cutout for drive device
53*u* cutout for guide rollers
53*t* cutout for receiving apparatus
54*a* cutout for base plate
54*b* cutout for base plate
54*c* cutout for base plate
55 handle
551 handle contour
552 hand guard
56 scraper
6 receiving apparatus
61 allocator
62 pressure rollers
105 frame
105*b* base plate
105*f* flat frame
BB bending region
BL longitudinal-side bending edge
BS end-face bending edge
BE intervention-guard bending edge
BH hand-guard bending edge

What is claimed is:

1. A method for producing a cutting machine with a transport device, the transport device comprising a frame, the transport device being for receiving slices of material separated by a cutting blade of the cutting machine, the method comprising:

producing the frame, the producing of the frame comprising:

providing a single integral workpiece, the single integral workpiece comprising a base plate region, a first longitudinal side region on a first side of the base plate region, and a second longitudinal side region on a second side of the base plate region, bending the first longitudinal side region along a first longitudinal side bending edge until the first longitudinal side region is perpendicular to the base plate region, and bending the second longitudinal side region along a second longitudinal side bending edge until the second longitudinal side region is perpendicular to the base plate region, wherein the first longitudinal side region and the second longitudinal side region each extend away from the base plate region in a first direction and are parallel to each other, assembling the transport device comprising coupling guide rollers to the frame, providing a machine housing of the cutting machine, the cutting blade being rotatably attached to the machine housing; and attaching the transport device to the machine housing in a region at a first side of the cutting blade, the first side of the cutting blade being opposite a second side of the cutting blade which is configured to face the material to be separated by the cutting blade, wherein the workpiece comprises a cutout of a handle contour in the first longitudinal side region.

2. The method according to claim 1, wherein the workpiece comprises guide roller cutouts in the first longitudinal side region and the second longitudinal side region, wherein the guide roller cutouts are positioned and dimensioned such that, after the bending of the first longitudinal side region and the second longitudinal side region, the guide roller cutouts are configured to receive a web that retains the guide rollers, and wherein the coupling the guide rollers to the frame comprises inserting the web into the guide roller cutouts.

3. The method according to claim 1, wherein the frame is produced without a joining process, a welding process, a screwing process, or a riveting process.

4. The method according to claim 1, wherein the workpiece comprises a tab cutout in the base plate region adjacent to the cutout of the handle contour, and wherein the method comprises bending the tab cutout along a hand guard bending edge such that the tab cutout extends away from a planar surface of the base plate region in the first direction to form a handle guard.

5. The method according to claim 1, wherein the frame is produced without including material foreign to the single integral workpiece.

6. The method according to claim 1, wherein the workpiece comprises an upper intervention guard region adjacent to the first longitudinal side region at a side opposite the first longitudinal side bending edge, and wherein the method comprises bending the workpiece at an intervention-guard bending edge to angle the upper intervention guard region toward the second longitudinal side region, the intervention-guard bending edge being between the upper intervention guard region and the first longitudinal side region.

7. The method according to claim 1, wherein the workpiece comprises a lateral intervention guard region extending from the base plate region at an end face of the frame, and wherein the method comprises bending the workpiece at an end-face bending edge such that the lateral intervention guard region extends from the base plate region at least partially in the first direction.

8. The method according to claim 1, wherein the workpiece comprises:

a scraper extension region extending from the base plate region;

a bending region extending from the scraper extension region; and a scraper region extending from the bending region, and wherein the method comprises bending the bending region to provide a curvature having a predefined radius.

9. The method of claim 1, wherein providing the workpiece comprises:

providing a flat plate; and cutting a two-dimensional flat pattern into the flat plate to provide the workpiece.

10. The method according to claim 9, wherein the flat plate is a metal plate or a plastic plate.

11. A method for producing a cutting machine with a transport device, the transport device comprising a frame, the transport device being for receiving slices of material separated by a cutting blade of the cutting machine, the method comprising:

producing the frame, the producing of the frame comprising:

providing a single integral workpiece, the single integral workpiece comprising a base plate region, a first longitudinal side region on a first side of the base plate region, and a second longitudinal side region on a second side of the base plate region, bending the first longitudinal side region along a first longitudinal side bending edge until the first longitudinal side region is perpendicular to the base plate region, and bending the second longitudinal side region along a second longitudinal side bending edge until the second longitudinal side region is perpendicular to the base plate region, wherein the first longitudinal side region and the second longitudinal side region each extend away from the base plate region in a first direction and are parallel to each other, assembling the transport device comprising coupling guide rollers to the frame, providing a machine housing of the cutting machine, the cutting blade being rotatably attached to the machine housing; and attaching the transport device to the machine housing in a region at a first side of the cutting blade, the first side of the cutting blade being opposite a second side of the cutting blade which is configured to face the material to be separated by the cutting blade, wherein the workpiece comprises longitudinal extension regions, respectively extending longitudinally from the first longitudinal side region and the second longitudinal side region, wherein drive device cutouts are in the longitudinal extension regions, the drive device cutouts being positioned and dimensioned such that, after the bending of the first longitudinal side region and the second longitudinal side region, the drive device cutouts are configured to receive a drive device, and wherein receiving apparatus cutouts are provided in the longitudinal extension regions, the receiving apparatus cutouts being positioned and dimensioned such that, after the bending of the first longitudinal side region and the second longitudinal side region, the receiving apparatus cutouts are configured to receive fasteners for fastening a receiver to the frame.

12. A cutting machine, the cutting machine comprising:

a machine housing;

a cutting blade rotatably attached to the machine housing;

a transport device for receiving slices of a first material separated by the cutting blade of the cutting machine, the transport device comprising guide rollers coupled to a frame, the frame consisting of a single integral piece of a second material, the frame comprising:

a base plate;

a first longitudinal side on a first side of the base plate, and a second longitudinal side on a second side of the base plate, wherein the first longitudinal side and the second longitudinal side extend from the base plate in a first direction, are perpendicular to the base plate, and are parallel to each other, wherein the transport device is attached to the machine housing in a region at a first side of the cutting blade, the first side of the cutting blade being opposite a second side of the cutting blade that is configured to face the first material to be separated by the cutting blade, wherein the frame comprises longitudinal extension regions, respectively extending longitudinally from the first longitudinal side and the second longitudinal side, wherein drive device cutouts are in the longitudinal extension regions, the drive device cutouts being positioned and dimensioned to receive a drive device, and wherein receiving apparatus cutouts are in the longitudinal extension regions, the receiving apparatus cutouts being positioned and dimensioned to receive fasteners for fastening a receiver to the frame.

13. The cutting machine according to claim 12, wherein the frame comprises a lateral intervention guard extending from the base plate at an end face of the frame, the lateral intervention guard extending from the base plate at least partially in the first direction.

14. The cutting machine according to claim 12, wherein the frame has guide roller cutouts in the first longitudinal side and the second longitudinal side, wherein the guide roller cutouts are positioned and dimensioned to receive a web that retains the guide rollers, and wherein the web is positioned in the guide roller cutouts, coupling the guide rollers to the frame.

15. The cutting machine according to claim 12, wherein the frame has a cutout of a handle contour in the first longitudinal side.

16. The cutting machine according to claim 15, wherein the frame comprises a tab at the base plate adjacent to the cutout of the handle contour, the tab extending away from a planar surface of the base plate in the first direction to form a handle guard.

17. The cutting machine according to claim 12, wherein the frame comprises a scraper curving away from the base plate at a predefined radius.

18. The cutting machine according to claim 12, wherein the frame comprises an upper intervention guard adjacent to the first longitudinal side, the upper intervention guard being angled toward the second longitudinal side.

* * * * *